US009807511B2

(12) United States Patent
Schoeffmann et al.

(10) Patent No.: US 9,807,511 B2
(45) Date of Patent: Oct. 31, 2017

(54) SPEAKER WITH A COIL STABILIZER AND METHOD FOR MANUFACTURING THE SAME

(71) Applicant: Sound Solutions International Co., Ltd., Beijing (CN)

(72) Inventors: Michael Schoeffmann, Baden (AT); Christian Haas, Gross St. Florian (AT); Helmut Wasinger, Hinterbruhl (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 14/928,413

(22) Filed: Oct. 30, 2015

(65) Prior Publication Data

US 2017/0127186 A1 May 4, 2017

(51) Int. Cl.

| | |
|---|---|
| ***H04R 9/04*** | (2006.01) |
| ***H04R 7/26*** | (2006.01) |
| ***H04R 9/06*** | (2006.01) |
| ***H04R 31/00*** | (2006.01) |

(52) U.S. Cl.

CPC ..... *H04R 9/041* (2013.01); *H04R 7/26* (2013.01); *H04R 9/06* (2013.01); *H04R 31/006* (2013.01)

(58) Field of Classification Search

CPC .... H04R 9/00; H04R 29/003; H04R 2209/00; H04R 2209/41; H04R 9/04; H04R 9/041; H04R 9/045

USPC ..... 381/400, 404, 407, 411

See application file for complete search history.

(56) References Cited

U.S. PATENT DOCUMENTS

| | | | | | |
|---|---|---|---|---|---|
| 4,239,943 | A * | 12/1980 | Czerwinski | H04R 9/041 | 381/403 |
| 4,327,257 | A * | 4/1982 | Schwartz | H04R 9/045 | 381/405 |
| 4,387,275 | A * | 6/1983 | Shimada | H04R 1/225 | 381/407 |
| 4,508,941 | A * | 4/1985 | Wiggins | G01P 3/46 | 381/405 |
| 4,531,025 | A * | 7/1985 | Danley | H04R 1/06 | 381/404 |
| 4,933,975 | A * | 6/1990 | Button | H04R 9/045 | 381/397 |
| 5,123,053 | A * | 6/1992 | House | H04R 9/06 | 381/405 |
| 5,734,132 | A * | 3/1998 | Proni | H04R 7/20 | 381/407 |
| 5,848,174 | A * | 12/1998 | Ki | H04R 9/06 | 381/405 |
| 6,735,322 | B1 * | 5/2004 | Watanabe | H04R 9/041 | 381/404 |
| 7,039,213 | B2 * | 5/2006 | Hyre | H04R 9/06 | 381/412 |

(Continued)

*Primary Examiner* — Suhan Ni

(74) *Attorney, Agent, or Firm* — Steven McMahon Zeller; Dykema Gossett PLLC

(57) ABSTRACT

A speaker and method for making the same are provided. The speaker includes a permanent magnet and a coil disposed about a first axis around the permanent magnet, the coil being configured to move along the first axis. The speaker further includes a membrane attached to a top surface of the coil and a stabilizer contacting at least one of an internal surface, an external surface, and a bottom surface of the coil, and configured to limit movement of the coil relative to a second axis perpendicular to the first axis.

15 Claims, 5 Drawing Sheets

(56) References Cited

U.S. PATENT DOCUMENTS

| | | | | |
|---|---|---|---|---|
| 8,290,199 | B2 * | 10/2012 | Pircaro | H04R 9/043 381/404 |
| 2015/0146912 | A1 * | 5/2015 | Wang | H04R 31/006 381/400 |

* cited by examiner

SPEAKER WITH A COIL STABILIZER AND METHOD FOR MANUFACTURING THE SAME

BACKGROUND a. Technical Field

This disclosure generally relates to a speaker and a method for manufacturing the same. In particular, the instant disclosure relates to a speaker with a coil stabilizer.

b. Background Art

This background description is set forth below for the purpose of providing context only. Therefore, any aspects of this background description, to the extent that it does not otherwise qualify as prior art, is neither expressly nor impliedly admitted as prior art against the instant disclosure.

Microspeakers (i.e., electroacoustic transducers) are loudspeakers used to reproduce sound in microelectronic equipment such as mobile phones, cellular phones, camcorders, mp3 players, navigation systems, PDAs, digital cameras, notebook computers, LCD TVs, DVD players, etc. Microspeakers are used when space is at a premium. In such applications, it is desired that the speaker (including the back volume) should be as compact as possible. However, it is also desired that the speaker should be able to output in the broadest range of frequencies possible. These are conflicting requirements.

The microspeaker may comprise a membrane attached to a voice coil, which may be positioned within a magnetic field defined by a permanent magnet and yoke or pot arrangement. Some applications require the coil to have a length greater than its width (for example, 3:1 or 2:1). It may also be desirable for the coil (disposed about an axis) to only move along that axis. As such, it may be undesirable for the coil to move in other directions along/about other axes. With a length-width proportion of 3:1, for example, the coil may be more inclined to move in such undesirable directions. Therefore, there is a need for a speaker and a method for manufacturing a speaker that will minimize and/or eliminate one or more of the above-identified deficiencies.

The foregoing discussion is intended only to illustrate the present field and should not be taken as a disavowal of claim scope.

SUMMARY

A speaker in accordance with one embodiment of the present teachings comprises a permanent magnet and a coil disposed about a first axis and around the permanent magnet. The coil is configured to move along the first axis. The speaker further includes a membrane coupled to a top surface of the coil and a stabilizer contacting at least one of an internal surface, an external surface, and a bottom surface of the coil, and configured to limit movement of the coil relative to a second axis perpendicular to the first axis.

A method for manufacturing a speaker in accordance with another embodiment of the present teachings comprises providing a permanent magnet. The method further comprises providing a coil with an internal surface, an external surface, a top surface, and a bottom surface. The method further includes attaching a stabilizer to at least one of the internal surface, external surface, and bottom surface of the coil. The method further includes coupling the top surface of the coil to a membrane. The method further includes assembling the speaker by suspending the membrane, such that the coil is disposed about a first axis and around the permanent magnet. The stabilizer is configured to limit movement of the coil relative to a second axis perpendicular to the first axis.

The foregoing and other aspects, features, details, utilities, and advantages of the present disclosure will be apparent from reading the following description and claims, and from reviewing the accompanying drawings.

DETAILED DESCRIPTION

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It will be appreciated that for conciseness and clarity, spatial terms such as "vertical," "horizontal," "up," and "down" may be used herein with respect to the illustrated embodiments. However, speakers may be used in many orientations and positions, and these terms are not intended to be limiting or absolute.

Figure 1:
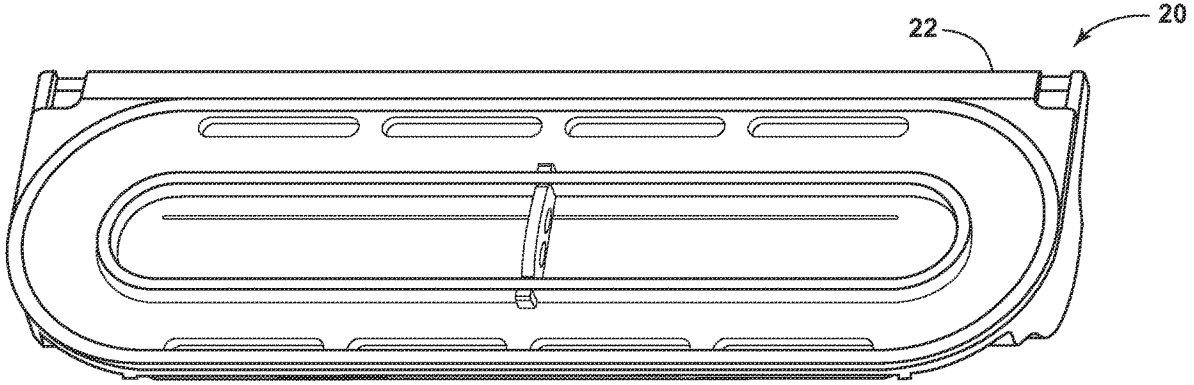
FIG. 1 is a perspective view of a speaker in accordance with one embodiment of the present teachings.
Figure 2:
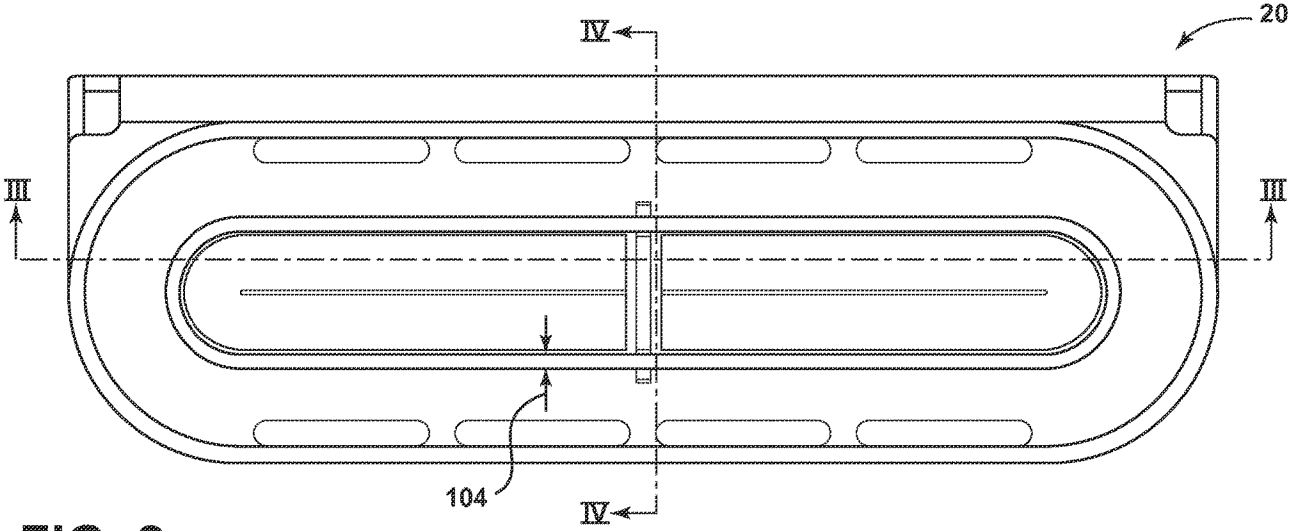
FIG. 2 is a top view of the speaker of FIG. 1.
Figure 3:
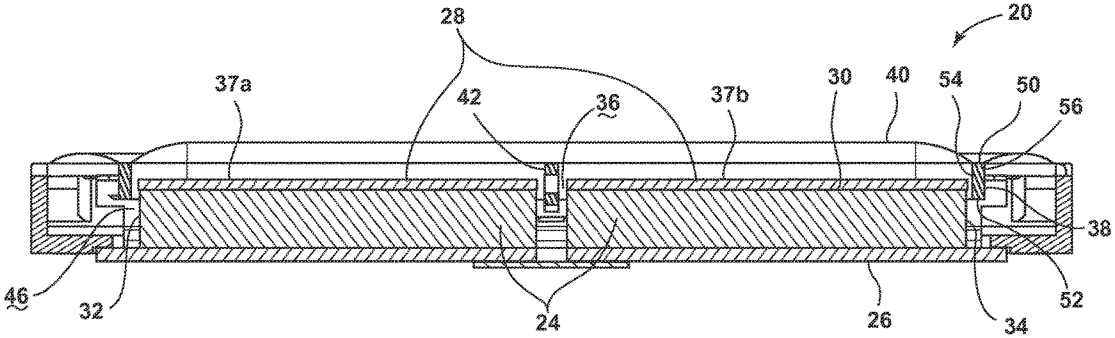
FIG. 3 is a cross-sectional view of the speaker of FIG. 2 taken along line III-III.
Figure 4:
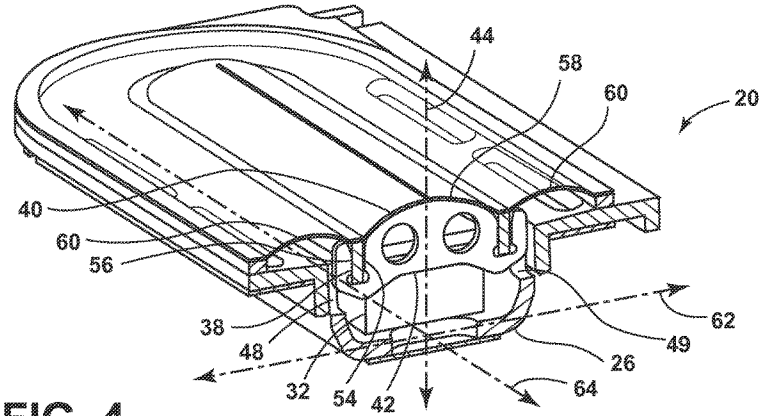
FIG. 4 is a cross-sectional view of the speaker of FIG. 2 taken along line IV-IV.

Referring now to the drawings wherein like reference numerals are used to identify identical or similar components in the various views, FIGS. 1-4 illustrate a speaker 20 in accordance with one embodiment of the present teachings. Speaker 20 may comprise a magnetic circuit for generating magnetic flux, a vibration system that vibrates due to repulsive force against the magnetic flux acting on the magnetic circuit, and a main body or frame 22. With particular reference to FIGS. 3-4, the magnetic circuit may comprise a permanent magnet 24, a pot 26 with magnet 24 disposed thereon, and an upper plate 28 attached to an upper surface 30 of magnet 24. In the illustrated embodiment, magnet 24 comprises portion 32 and portion 34 adjacent to portion 32 with a gap 36 disposed therebetween. Upper plate 28 may be configured to assist in generation of the magnetic field. In the illustrated embodiment, upper plate 28 comprises portion 37*a* and portion 37*b* with portion 37*a* being attached to portion 32 of magnet 24 and portion 37*b* being attached to portion 34 of magnet 24. In other embodiments, magnet 24 and upper plate 28 each comprises only one portion or more than two portions.

Referring particularly to FIG. 4, the vibration system may comprise a voice coil 38, a membrane 40, and a coil stabilizer 42. Coil 38 may be configured to generate magnetic flux when an electric current is driven into coil 38. In response to the electric current, coil 38 may be configured to move along an axis 44. In an embodiment, coil 38 may be disposed about axis 44 and around magnet 24 in a gap 46 (FIG. 3) between magnet 24 and pot 26. Pot 26 may define slots 48, 49 through which stabilizer 42 may travel (with coil 38). As shown in FIG. 3, coil 38 may comprise a top surface 50 to which membrane 40 may be coupled, a bottom surface 52, an internal surface 54, and an external surface 56. The electrical connections to coil 38 are not shown; however, spring clips may be used to provide external connections to coil 38. As shown in FIG. 4, membrane 40 may have a central region 58 and a torus 60 forming a supporting edge region, which may define the compliance of membrane 40. In an embodiment, membrane 40 may be composed of an elastomer material, as described in U.S. Patent Publication No. 2012/0093353 A1, the entire disclosure of which is incorporated herein by reference as though set forth in its entirety.

Stabilizer 42 may be configured to stabilize coil 38 as coil 38 moves along axis 44. In some embodiments, stabilizer 42 may limit movement of coil 38 in directions other than along axis 44. For example and without limitation, stabilizer 42 may be configured to limit movement of coil 38 relative to an axis 62 and/or an axis 64, which are each perpendicular to axis 44 and (together with axis 44) define a three-dimensional coordinate system. Moreover, in some embodiments, stabilizer 42 may be configured to limit rotation of coil 38 about axis 44, axis 62, and/or axis 64 (i.e., yaw, pitch, and roll).

Figure 5:
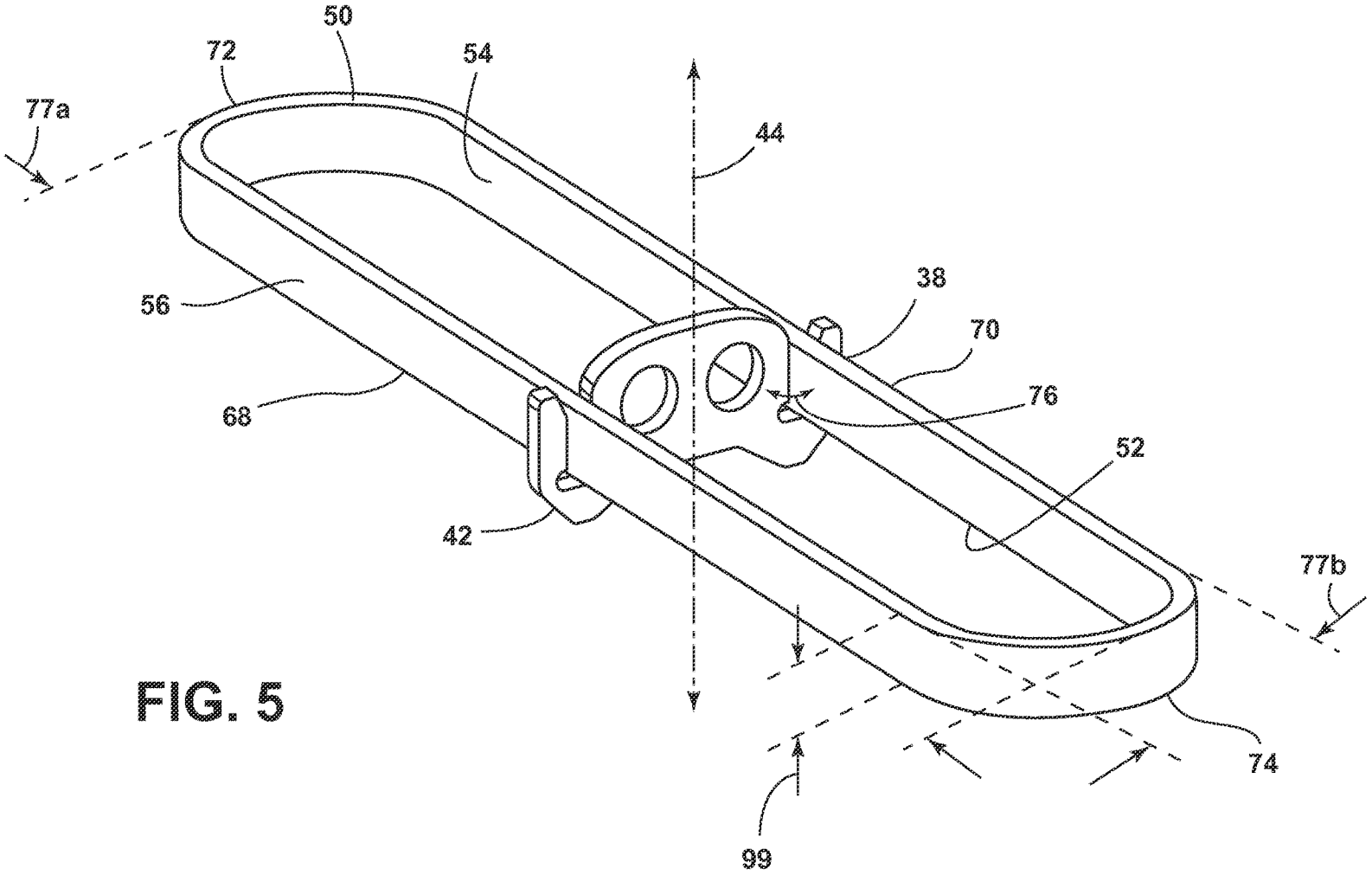
FIG. 5 is a perspective view of a coil stabilizer coupled to a coil of the speaker of FIG. 1.
Figure 6:
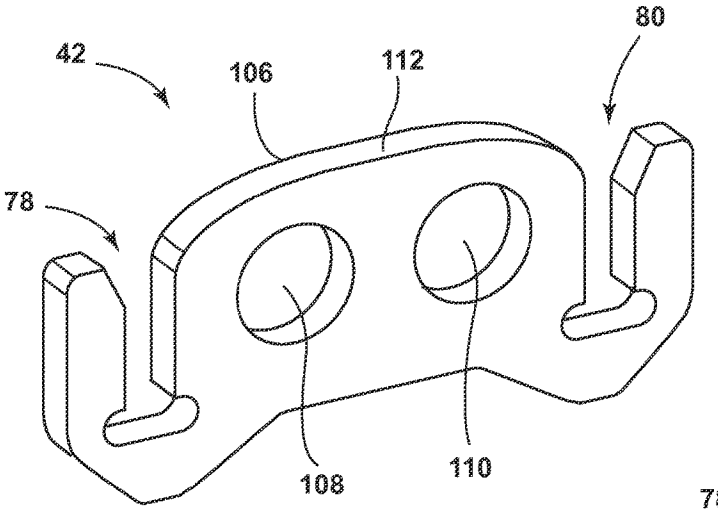
FIG. 6 is a perspective view of the stabilizer illustrated in FIG. 5.
Figure 7:
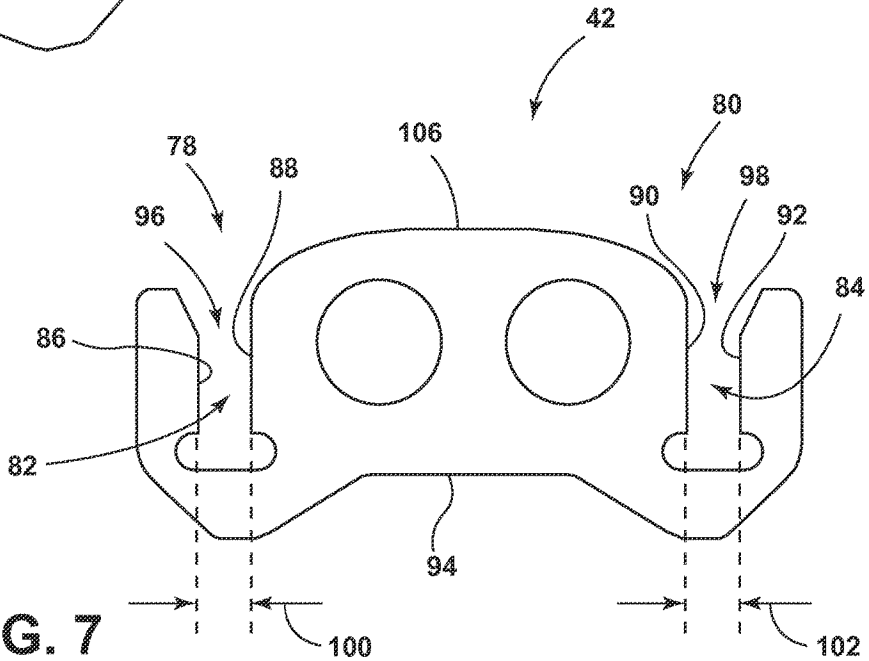
FIG. 7 is a side view of the stabilizer illustrated in FIG. 5.

FIGS. 5-7 illustrate the shape and function of stabilizer 42 relative to coil 38. In the illustrated embodiment, stabilizer 42 extends through axis 44 from the center of a segment 68 of coil 38 to the center of a segment 70 of coil, segment 70 being diametrically opposed of (and generally parallel to) segment 68 relative to axis 44. In other embodiments, stabilizer 42 extends from a segment 72 of coil 38 to a segment 74 of coil 38, segment 74 being diametrically opposed of segment 72 relative to axis 44. Although in the illustrated embodiment, stabilizer 42 extends through axis 44 at an angle 76 perpendicular to segments 68, 70, one of ordinary skill in the art will understand that stabilizer 42 may be disposed at various locations about coil 38 and may extend at various angles relative to segments 68, 70, 72, 74. Moreover, more than one stabilizer may be used for the same coil. For example and without limitation, one stabilizer may extend from segment 68 to segment 70, and another stabilizer may extend from segment 72 to segment 74 (the two stabilizers intersecting one another). In such an embodiment, the two stabilizers may be coupled to one another. In the illustrated embodiment, coil 38 has a length 77*a* (generally defined by segments 68, 70) and a width 77*b* (generally defined by segments 72, 74), with width 77*b* being approximately one third in magnitude of length 77*a* (i.e., length-width proportion is 3:1). Although stabilizer 42 is illustrated as being coupled to segments 68, 70, which generally have length 77*a* (the greater dimension in the illustrated embodiment), one of ordinary skill in the art will understand that stabilizer 42 can be adapted for coils having any length-width proportions (for example and without limitation, 1:1 or 2:1) and may be coupled to segments having the lesser dimension of length and width.

Referring particularly to FIG. 7, stabilizer 42 may comprise ends 78, 80 with slots 82, 84. Slots 82, 84 may be defined at least partially by walls 86, 88, 90, 92 and a base 94 connecting walls 86, 88, 90, 92. In the illustrated embodiment, ends 78, 80 are generally U-shaped such that walls 88, 90 each extend along internal surface 54, walls 86, 92 each extend along external surface 56, and base 94 extends along bottom surface 52 of coil 38 with slots 82, 84 each having an opening 96, 98. Walls 86, 88, 90, 92 may extend along a majority of a height 99 (FIG. 5) of the coil 38. As shown in FIG. 5, segments 68, 70 of coil 38 may extend through slots 82, 84, respectively, such that coil 38 is releasably secured inside slots 82, 84. In the illustrated embodiment, wall 86 abuts external surface 56 of segment 68 of coil 38; wall 88 abuts internal surface 54 of segment 68; wall 90 abuts internal surface 65 of segment 70; and wall 92 abuts external surface 56 of segment 70. As illustrated in FIG. 7, in one embodiment, widths 100,102 of slots 82, 84 are approximately equal to a width 104 (FIG. 2) of coil 38. With such a configuration, opposing compressive forces from stabilizer 42 onto coil 38 (and their respective reaction forces) aid in retaining coil 38 within stabilizer 42. Furthermore, slots 82, 84 may be widened proximate to bottom surface 52 of coil 38 to provide a sufficient area for housing an adhesive used to secure coil 38 to stabilizer 42. Stabilizer 42 may be coupled to coil 38 via the use of these compressive forces and/or through adhesives. Additionally, in the illustrated embodiment, to assist with assembly and to avoid damage to coil 38, slots 82, 84 are generally chamfered at openings 96, 98, and base 94 of stabilizer 42 is generally V-shaped at ends 78, 80. Although in the illustrated embodiment, stabilizer 42 is attached and/or coupled to internal surface 54, external surface 56, and bottom surface 52 of coil 38 (or at least to portions thereof) with ends 78, 80 being generally U-shaped, one of ordinary skill in the art will understand that stabilizer 42 may be attached to and/or be configured to contact only one or two of such surfaces. For example, and without limitation, stabilizer 42 may be attached to only bottom surface 52 of coil 38 and not extend along internal surface 54 and external surface 56 of coil 38. Furthermore, one of ordinary skill in the art will understand that slots 82, 84 can take on any shape besides that which is illustrated in the Figures.

Referring to FIG. 6, stabilizer 42 may further comprise an intermediate section 106 disposed between ends 78, 80. In the illustrated embodiment, intermediate section 106 contains two apertures 108, 110 which reduce the overall weight of stabilizer 42. In other embodiments, intermediate section 106 has less than or more than two apertures (see FIGS. 8-10 for an embodiment with three apertures). Apertures 108, 110 can be of any size. In yet a further embodiment, intermediate section 106 contains no apertures and serves as a bridge connecting ends 78, 80, which may result in an even lesser overall weight of stabilizer 42. Intermediate section 106 may comprise a top surface 112 that is generally convex such that top surface 112 aids in supporting central region 58 of membrane 40 (FIGS. 3-4). In other embodiments (such as the embodiment illustrated in FIGS. 8-10), top surface 112 may be flat and may or may not support membrane 40.

Although stabilizer 42 is shown as being disposed along a majority of internal surface 54 and external surface 56 of coil 38, stabilizer 42 may be disposed only internally or only externally of coil 38. For example and without limitation, stabilizer 42 can be constructed with no intermediate section 106 and/or "float" about coil 38. In one embodiment, stabilizer 42 may be in the form of a sleeve that circumferentially surrounds at least a portion of external surface 56 of coil 38. Furthermore, although stabilizer 42 is illustrated as being coupled to coil 38, stabilizer 42 may instead be stationary and disposed near coil 38 (for example and without limitation, acting as a guide). In such an embodiment, stabilizer 42 may only contact coil 38 if coil 38 moves in an undesirable direction (i.e., in a direction other than along axis 44) to maintain movement of coil 38 along axis 44. In such an embodiment, at least a portion of stabilizer 42 may be attached to frame 22, pot 26, and/or upper plate 28 of magnet 24. In another embodiment, stabilizer 42 may be in the form of one or more support members disposed along frame 22, pot 26 and/or upper plate 28 and protruding therefrom to contact at least one of internal surface 54, external surface 56, and bottom surface 52 of coil 38 as coil 38 moves along axis 44. In yet another embodiment, stabilizer 42 is not coupled to coil 38 but, instead, is coupled to membrane 40 and, thus, moves with membrane 40 (and coil 38 would float within slots 82, 84 of stabilizer 42). In yet a further embodiment, stabilizer 42 may contact top surface 50 of coil 38 and be at least partially disposed between top surface 50 of coil 38 and membrane 40 with stabilizer 42 being coupled to membrane 40. In such a configuration, U-shaped ends 78, 80 of stabilizer 42 may be inverted such that openings 96, 98 are proximate to bottom surface 52 of coil 38.

In yet another embodiment, stabilizer 42 may consist of several portions coupled to coil 38 at various locations around coil 38, with one or more portions coupled to one another via bridges disposed along internal surface 54 and/or external surface 56 of coil 38. With such a configuration, each portion (disposed at different locations around coil 38) are interconnected with some or all of the other portions and, together, serve as support for coil 38.

Although the instant disclosure discusses ends 78, 80 of stabilizer 42 being generally U-shaped, one of ordinary skill in the art will appreciate that ends 78, 80 do not have to be U-shaped, but instead could extend along one of internal surface 54 and external surface 56 of coil 38. Furthermore, stabilizer 42 may consist of one or more bridges that extend within coil 38 and are coupled at least to internal surface 54 of coil 38.

Figure 8:
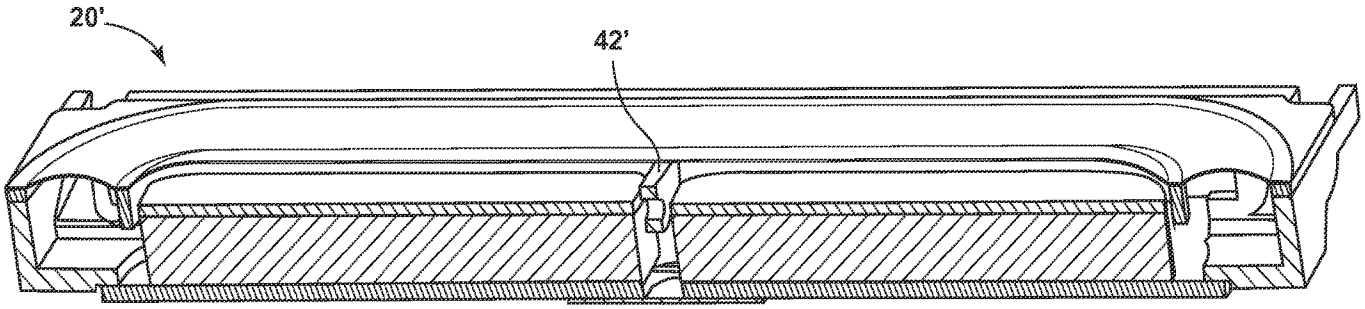
FIG. 8 is a cross-sectional perspective view of a speaker in accordance with another embodiment of the present teachings.
Figure 9:
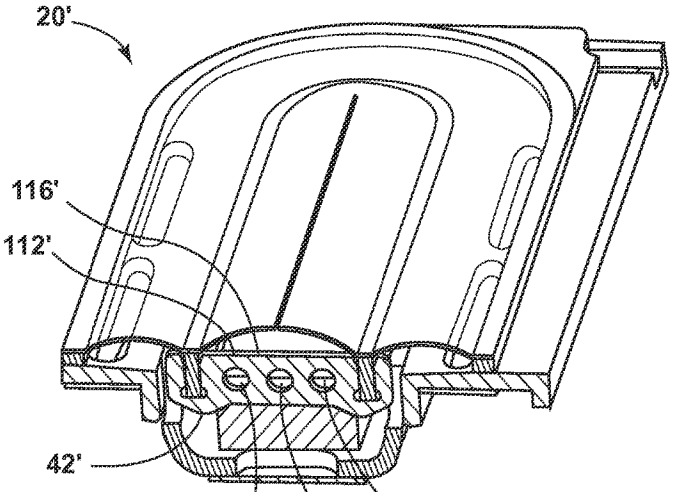
FIG. 9 is a cross-sectional perspective view of the speaker of FIG. 8.
Figure 10:
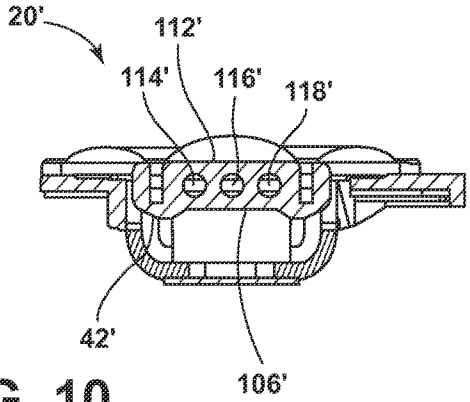
FIG. 10 is a side view of the speaker of FIG. 8.

FIGS. 8-10 illustrate another embodiment of the present teachings and include various views of a stabilizer 42'. Stabilizer 42' may be similar to the stabilizer 42 illustrated in FIGS. 1-7, except that stabilizer 42' comprises three apertures 114', 116', 118' in intermediate section 106' with top surface 112' of intermediate section 106' being flat.

The foregoing numerous embodiment solve one or more problems known in the art.

Although only certain embodiments have been described above with a certain degree of particularity, those skilled in the art could make numerous alterations to the disclosed embodiments without departing from the scope of this disclosure. All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments. Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. It is intended that all matter contained in the above description or shown in the accompanying drawings shall be interpreted as illustrative only and not limiting. Changes in detail or structure may be made without departing from the invention as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference.

While one or more particular embodiments have been shown and described, it will be understood by those of skill in the art that various changes and modifications can be made without departing from the spirit and scope of the present teachings.

What is claimed is:

1. A speaker comprising:

a permanent magnet comprising a first portion and a second portion adjacent to the first portion;

a coil disposed about a first axis and around the permanent magnet, the coil being configured to move along the first axis;

a membrane coupled to a top surface of the coil; and a stabilizer at least partially disposed between the first and second portions of the permanent magnet, the stabilizer contacting an internal surface, an external surface, and a bottom surface of the coil, and configured to limit movement of the coil relative to a second axis perpendicular to the first axis.

2. The speaker of claim 1, wherein the stabilizer is further configured to limit movement of the coil relative to a third axis perpendicular to the first and second axes.

3. The speaker of claim 1, wherein the stabilizer is attached to at least one of the internal surface, external surface, and bottom surface of the coil via an adhesive.

4. The speaker of claim 1, wherein the stabilizer extends from a first segment of the coil to a second segment of the coil diametrically opposed of the first segment relative to the first axis.

5. The speaker of claim 4, wherein the first and second segments of the coil define a length of the coil that is greater than a width of the coil.

6. The speaker of claim 1, wherein the coil extends through a first slot and a second slot of the stabilizer.

7. The speaker of claim 6, wherein the coil comprises a first segment and a second segment diametrically opposed of the first segment relative to the first axis, the first segment of the coil extends through the first slot of the stabilizer, and the second segment of the coil extends through the second slot of the stabilizer.

8. The speaker of claim 6, wherein the first and second slots are widened proximate to the bottom surface of the coil to allow for deposit of an adhesive.

9. The speaker of claim 6, wherein the coil is releasably secured inside the first and second slots of the stabilizer.

10. The speaker of claim 1, wherein the stabilizer supports the membrane.

11. The speaker of claim 10, wherein a top surface of the stabilizer is configured to contact the membrane.

12. The speaker of claim 1, wherein the stabilizer comprises a first end and a second end that are generally U-shaped such that the first and second ends each extend around a portion of the internal surface of the coil, a portion of the external surface of the coil, and the bottom surface of the coil.

13. The speaker of claim 12, wherein at least a portion of the first and second ends of the stabilizer extends along a majority of a height of the coil.

14. The speaker of claim 12, wherein the stabilizer comprises a first wall abutting the external surface of a first segment of the coil, a second wall abutting the internal surface of the first segment of the coil, a third wall abutting the internal surface of a second segment of the coil, a fourth wall abutting the external surface of the second segment of the coil, and a base connecting the first, second, third, and fourth walls of the stabilizer.

15. The speaker of claim 12, wherein the stabilizer extends perpendicularly from a first segment of the coil to a second segment of the coil that is diametrically opposed of the first segment relative to the first axis.

* * * * *